US007946062B2

(12) United States Patent
Kelly

(10) Patent No.: US 7,946,062 B2
(45) **Date of Patent: *May 24, 2011**

(54) STUDDED FOOTWEAR

(75) Inventor: Paul Andrew Kelly, Warwickshire (GB)

(73) Assignee: Trisport Limited, Gaithersburg, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/501,646

(22) Filed: Jul. 13, 2009

(65) Prior Publication Data

US 2009/0272012 A1 Nov. 5, 2009

Related U.S. Application Data

(63) Continuation of application No. 10/409,185, filed on Apr. 9, 2003, now Pat. No. 7,559,160.

(60) Provisional application No. 60/393,655, filed on Jul. 5, 2002.

(30) Foreign Application Priority Data

Apr. 9, 2002 (GB) ..... 0208144.6

(51) Int. Cl.
*A43B 5/00* (2006.01)
*A43B 23/28* (2006.01)

(52) U.S. Cl. ..... 36/127; 36/59 C; 36/59 R; 36/134; D2/906; D2/957

(58) Field of Classification Search ..... 36/134, 36/114, 128, 59 C, 67 D, 67 A, 67 R, 7.7, 36/7.6, 59 A; D2/957
See application file for complete search history.

(56) References Cited

U.S. PATENT DOCUMENTS

| | | | | |
|---|---|---|---|---|
| 3,918,181 | A | 11/1975 | Inohara | |
| 4,375,728 | A | 3/1983 | Dassler | |
| D400,346 | S * | 11/1998 | Singer | D2/959 |
| D406,938 | S * | 3/1999 | Lin | D2/954 |
| D412,392 | S * | 8/1999 | Singer | D2/951 |
| 6,016,613 | A * | 1/2000 | Campbell et al. | 36/59 C |
| D420,209 | S * | 2/2000 | Singer | D2/951 |
| 6,023,860 | A | 2/2000 | McMullin | |
| 6,161,315 | A | 12/2000 | Dalton | |
| 6,167,641 | B1 | 1/2001 | McMullin | |
| D447,852 | S * | 9/2001 | Schroeder et al. | D2/954 |
| 6,289,611 | B1 | 9/2001 | Patterson | |
| 6,305,104 | B1 | 10/2001 | McMullin | |
| 6,463,682 | B1 | 10/2002 | Carroll | |
| D468,515 | S * | 1/2003 | Lane et al. | D2/951 |
| 6,675,505 | B2 | 1/2004 | Terashima | |
| 6,694,647 | B1 | 2/2004 | Patterson | |
| 6,705,027 | B1 | 3/2004 | Campbell | |
| 6,708,428 | B2 | 3/2004 | Chen | |

FOREIGN PATENT DOCUMENTS

| | | |
|---|---|---|
| DE | 4417563 | 11/1995 |
| EP | 0282257 | 9/1988 |
| EP | 0922401 | 6/1999 |

(Continued)

*Primary Examiner* — Jila M Mohandesi
(74) *Attorney, Agent, or Firm* — Edell, Shapiro & Finnan, LLC

(57) ABSTRACT

An outsole for an article of studded footwear in which said outsole includes receptacles for specifically-oriented studs. The outsole also includes traction elements formed integrally with the outsole. The studs and traction elements being so constructed and arranged to interact in use of the footwear. The traction elements are designed to complement the spike configuration of the stud.

22 Claims, 2 Drawing Sheets

FOREIGN PATENT DOCUMENTS

| | | |
|---|---|---|
| JP | 2000245505 | 9/2000 |
| WO | 91/15131 | 10/1991 |
| WO | 9836653 | 8/1998 |
| WO | 99/09851 | 3/1999 |
| WO | 9937175 | 7/1999 |
| WO | 0064294 | 11/2000 |
| WO | 01/54527 | 8/2001 |
| WO | 01/58300 | 8/2001 |
| WO | 0154528 | 8/2001 |
| WO | 02/39840 | 5/2002 |

* cited by examiner

STUDDED FOOTWEAR

CROSS REFERENCE TO RELATED APPLICATIONS

This application claims priority to U.S. patent application Ser. No. 10/409,185, filed 9 Apr. 2003 now U.S. Pat. No. 7,559,160 and entitled "Studded Footwear," which claims priority under 35 U.S.C. §119 to U.S. Provisional Application No. 60/393,655, filed 5 Jul. 2002 and entitled "Studded Footwear," as well as under 35 U.S.C. §119 to Application No. GB0208144.6, filed on 9 Apr. 2002 and entitled "Studded Footwear." The disclosures of the aforementioned applications are hereby incorporated by reference in their entireties.

FIELD OF THE INVENTION

This invention relates to studded footwear such as sports shoes, for example football boots and golf shoes. The term "football" is intended to encompass all sports known as football, such as soccer, rugby and American and Australian football.

BACKGROUND OF THE INVENTION

The studs are intended to provide traction, having a ground-engaging part of a type suited to the sport involved. Thus, studs for football tend to have relatively sharp ground-piercing spikes, while those for golf shoes currently have relatively soft and blunt ground-gripping spikes. The studs are detachably fastened to the sole of the article of footwear by a screw-threaded spigot on the stud engaging in a correspondingly threaded socket in a receptacle molded in, or otherwise secured to the shoe sole. The screw thread may be single start or multi-start, and the stud and socket may also incorporate a locking ratchet to prevent accidental unscrewing of the stud.

The studs provide most, if not all, of the traction for the footwear and may be of different kinds, even for one sport. Thus, golf studs may have dynamic spikes which flex when pressure is applied to them, or static spikes, which do not flex. A dynamic spike may not always flex in the manner intended, depending on the surface or the way the pressure is applied.

Previously, rotational orientation of the studs relative to the shoe sole was not necessary, as most studs are circular or otherwise rotationally symmetrical. Their final orientation relative to the shoe sole is therefore not relevant.

However, in some sports where the forces on the studs are relatively high and of a particular type, such as lateral forces or forces due to rapid forward acceleration of the wearer of the shoe, studs which are specifically-oriented can be more effective. The term "specifically-oriented stud" will be used to include studs which are non-rotationally symmetrical, or studs which are rotationally symmetrical, but whose orientation relative to the shoe sole is significant. A specifically-oriented stud must be oriented very precisely relative to the shoe sole to ensure that it operates in the desired manner. Most known screw threads and locking ratchets are unable to provide this precise orientation. We have devised a system of ensuring the precise orientation of the stud relative to the receptacle. Orientation of the receptacle in the sole then provides the precise orientation of the stud relative to the sole.

SUMMARY OF THE INVENTION

According to the present invention, an outsole for an article of studded footwear includes receptacles for specifically-oriented studs and traction elements formed integrally with the outsole, the studs and traction elements being so constructed and arranged to interact in use of the footwear.

The ability to provide precise orientation of the stud relative to the outsole means that the outsole can be designed with traction elements that work with the studs to improve the overall traction of the outsole.

Thus, where the studs for golf shoes include dynamic spikes, the traction elements may be formed on one or both circumferential sides of at least one spike. The traction elements can then guide the spikes as they flex, and also act as static or dynamic traction elements. The traction elements may extend at any appropriate angle from the outsole. They may be V-shaped or triangular in profile.

The traction elements will be designed to complement the spike configuration of a stud, which depends on the positioning of the stud in the outsole and the forces on the outsole in use.

BRIEF DESCRIPTION OF THE DRAWINGS

An embodiment of the invention is illustrated by way of example in the accompanying drawings, in which.

DETAILED DESCRIPTION OF THE INVENTION

Figure 1:
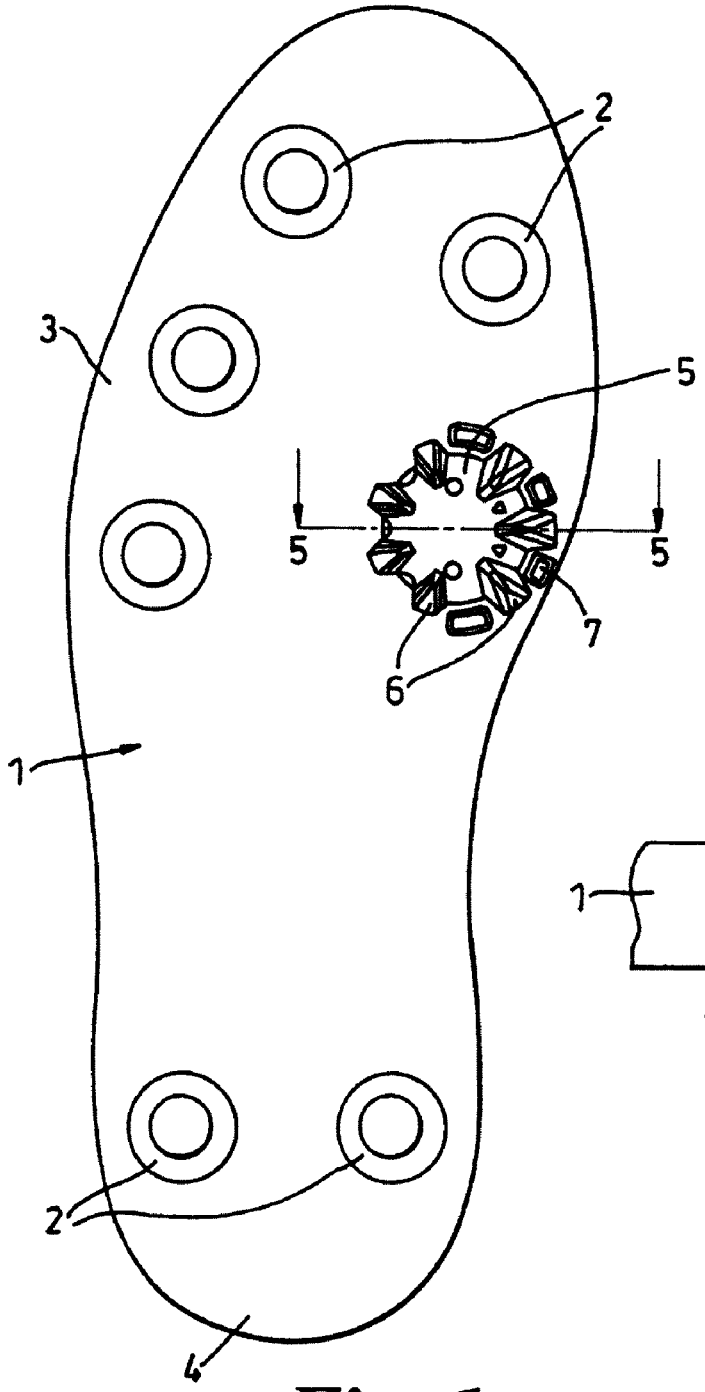
FIG. 1 is an underneath plan view of an outsole for a golf shoe with one stud attached.
Figure 2:
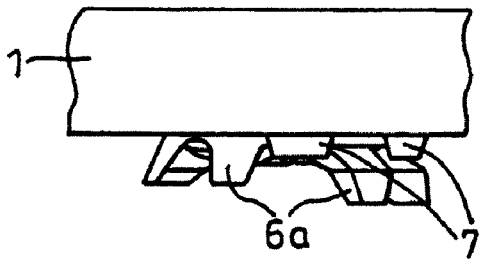
FIG. 2 is a side view of the stud of FIG. 1.
Figure 3:
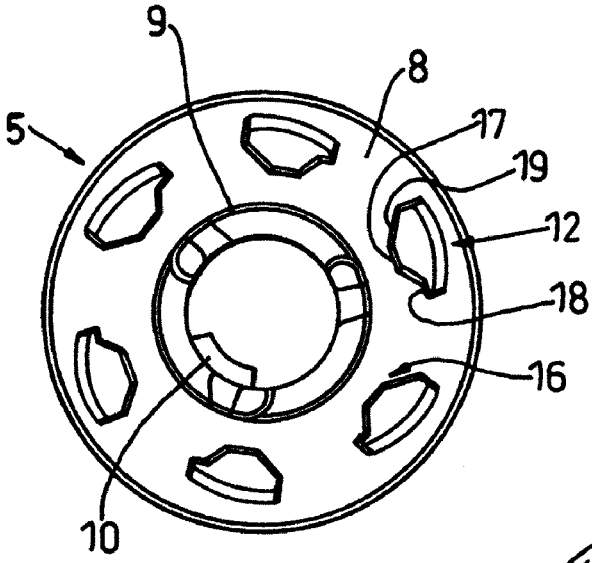
FIG. 3 is a top plan view of a stud.
Figure 4:
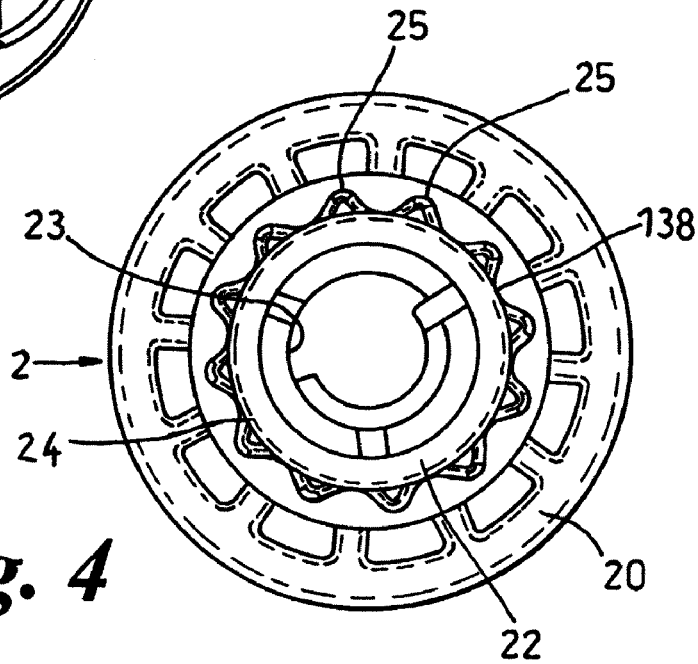
FIG. 4 is an underneath plan view of a receptacle.
Figure 5:
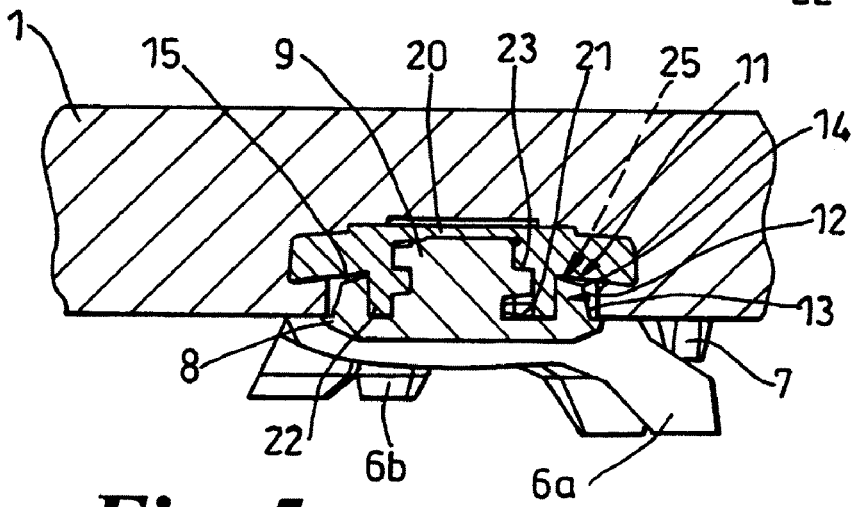
FIG. 5 is a scrap section along the line 5-5 of FIG. 1.

The outsole 1 of FIG. 1 is for a studded golf shoe. The outsole 1 is molded from rubber, and incorporates several receptacles 2, which are molded into the outsole 1 in the appropriate arrangement on the sole 3 and heel 4. Each receptacle 2 is adapted to receive a specifically-oriented stud 5 (only one of which is shown). The stud 5 has ground-engaging spikes 6 and the outsole 1 has integrally-formed traction elements 7, which in use interact with the spikes 6.

Each stud 5 is a unitary molding of plastics material, having a flange 8 with a screw-threaded spigot 9 projecting from a tipper side of the flange 8, while the spikes 6 project from the lower side. There are three dynamic spikes 6*a*, which flex when pressure is applied to them, and five static spikes 6*b*, which do not.

The spigot 9 has a multi-start external screw thread 10, with a relatively steep helix angle so that the stud 5 can be inserted in the receptacle 2 in half a turn. In order to define the initial position of the stud 5 relative to the receptacle 2, one of the threads on the spigot 9 is different from the others so that the screw thread 10 can only be engaged in one position of the stud 5 relative to the receptacle 2.

Because of the relatively steep helix angle of the thread, the frictional resistance to unscrewing of the stud 5 is relatively low. The stud 5 and receptacle 2 therefore have a locking means 11, which comprises a ring of resilient posts 12 on the stud 5 co-operating with a ring of teeth 25 in the receptacle 2, arranged so that engagement of the teeth with the posts causes resilient deflection of the posts, and engagement of the teeth between the posts inter-engages the locking means. This serves to secure the stud 5 in the receptacle 2 and to define its final position relative to the receptacle 2. The stud 5 is then precisely oriented in the receptacle 2 when it is fully engaged.

The resilient posts 12 extend axially from the upper side of the flange 8. They surround the spigot 9 and form a ring concentric with the spigot 9. There are six posts 12 distributed uniformly about the axis of the stud. The axial extent of each post 12 is about half the axial height of the spigot 9, and each post is radially resilient. The radially outer surface of each post 12 has a lower part-cylindrical portion 13 and an upper part-conical portion 14. The top surface 15 of each post 12 is angled up towards the spigot 9, so that the radially inner surface 16 of each post 12 has the greatest axial height. The radially inner surface 16 is generally convex towards the spigot 9, with a central convex region 17, a first circumferential end 18 having a concave profile towards the spigot 9, and a second circumferential end 19 having a convex profile towards the spigot 9. The first end 18 is the leading end and the second end 19 the trailing end on insertion of the stud 5, and vice versa when it is removed. The concave profile of the first end 18 presents less resistance on insertion of the stud, while the convex profile of the second end 29 presents greater resistance on removal.

The receptacle 2 is also a unitary molding of plastics material. It has a circular top plate 20 with a central boss 21 depending from it. The receptacle 2 is anchored in the outsole 1 by the top plate 20, which may include means (not shown) for ensuring that the receptacle 2 is precisely oriented relative to the outsole 1.

The boss 21 has a stout cylindrical wall 22, whose inside forms an internally screw-threaded socket 23 adapted to receive the spigot 9. The socket 23 also has a multi-start thread, with one of the grooves being different from the others, to complement the different thread 10 in the spigot 9. The radially outer surface 24 of the boss 21 is formed with the other part of the locking means 11, as the ring of axially-extending teeth 25, projecting radially outwards from the surface 24. In cross-section, the teeth 25 are generally triangular, but with a rounded apex.

The distance of radial projection of the teeth 25 from the socket axis is substantially equal to that of the inner surfaces of the posts 12 at the first end 19. There is therefore radial interference between the teeth 25 and posts 12, which causes frictional resistance to relative rotation of the stud 5 and receptacle 2.

The stud 5 is installed by the insertion of the spigot 9 into the socket 23. Because of the different thread 10 and groove, there is only one position in which the screw-threaded connection can engage. As the spigot 9 is rotated it is drawn into the socket 23, and the teeth 25 engage with the posts 12. The posts 12 deflect radially in a resilient manner to allow the teeth 25 to move past the posts 12. Once the spigot 9 has rotated through 180°, the stud 5 is fully inserted in the receptacle 2, and is secured by the inter-engagement of the teeth 25 and posts 12.

Thus, the position of the stud 5 in the receptacle 2 is precisely determined by the screw thread and the locking means 11. As the position of the receptacle 2 relative to the outsole 1 is also precisely determined, the spikes 6*a*, 6*b* of the stud 5 will be in a precisely determined position relative to the outsole 1, so that in use they can interact with the traction elements 7 on the outsole 1.

As shown in the Figures, four traction elements 7 are provided, so that there is one on each circumferential side of each dynamic spike 6*a*. Each traction element 7 is of substantially triangular form and projects from the outsole 1. The axial height of each traction element 7 is less than the axial extent of the dynamic spikes 6*a*. The elements 7 shown project substantially at right angles to the outsole 1, but may be at any suitable angle.

In use, when the shoe is worn, the weight of the wearer in the shoe causes the dynamic spikes 6*a* to flex radially outwards. Their movement is guided by the traction elements 7, which then also come into engagement with the ground to provide extra traction, as static spikes.

It will be appreciated that the construction and arrangement of the traction elements 7 will be designed to complement the studs 5 which are used. The traction elements 7 may therefore have different forms, and act dynamically or statically. It will also be appreciated that different thread forms and locking means may be used on the stud and receptacle, as required.

I claim:

1. An athletic shoe comprising:

an outsole;

a receptacle mounted in said outsole and having an internally threaded socket;

a stud having a flange, a threaded spigot extending from an upper side of said flange for threadedly engaging said socket about an axis, and at least one ground engaging dynamic spike extending from a lower side of said flange, said dynamic spike being sufficiently flexible to flex under the weight of a wearer of said shoe;

an outsole element extending downward from said outsole, wherein the axial height of said element is less than the axial extent of the dynamic spike, wherein said element is positioned sufficiently proximate said receptacle to permit said element to interact with said dynamic spike when flexing under said wearer weight; and a locking feature to secure said stud in said receptacle in at least one specific rotational position relative to said receptacle and said outsole when said spigot is threadedly engaged in said socket, wherein, in said specific rotational position, said dynamic spike is oriented to contact said element, wherein said dynamic spike, in said specific rotational position and when flexing under said wearer weight, contacts said element.

2. The athletic shoe of claim 1, wherein said element is formed integrally with said outsole.

3. The athletic shoe of claim 1, wherein said element is substantially inflexible as compared to said dynamic spike and is positioned to contact said dynamic spike in said specific rotational position and when said dynamic spike is flexing under said weight.

4. The athletic shoe of claim 1, wherein said element is flexible and is positioned to contact said dynamic spike in said specific rotational position when said dynamic spike is flexing under said weight.

5. The athletic shoe of claim 1, wherein said outsole element is a traction element.

6. The athletic shoe of claim 1, wherein:

said stud comprises a plurality of ground engaging dynamic spikes extending from said lower flange side, each of said plurality of dynamic spikes being sufficiently flexible to flex under said wearer weight;

said outsole comprises a plurality of elements positioned sufficiently proximate said receptacle such that selected elements within said plurality are permitted to interact with two or more of said plurality of dynamic spikes when flexing under said wearer weight;

said specific rotational position permits two or more of said plurality of dynamic spikes to interact with a corresponding element within said plurality of elements; and flexure of each said interacting dynamic spikes is guided by its corresponding element.

7. The athletic shoe of claim 1, wherein:

said stud comprises a plurality of ground engaging dynamic spikes extending from said lower flange side, each of said plurality of dynamic spikes being sufficiently flexible to flex under said wearer weight;

said outsole comprises a plurality of elements positioned sufficiently proximate said receptacle such that elements within the plurality are configured to interact with each of said plurality of dynamic spikes when flexing under said wearer weight;

said specific rotational position permits each of said plurality of dynamic spikes to interact with an associated element of said plurality of elements; and flexure of each of said interacting dynamic spikes is guided by its associated element.

8. The athletic shoe of claim 1, wherein:

said stud comprises a plurality of ground engaging dynamic spikes extending from said lower flange side, each of said plurality of dynamic spikes being sufficiently flexible to flex under said wearer weight;

said outsole comprises a plurality of elements positioned sufficiently proximate said receptacle such that each of said elements within said plurality are configured to interact with at least one dynamic spike within said plurality of dynamic spikes when flexing under said wearer weight;

said specific rotational position permits two or more dynamic spikes within said plurality of dynamic spikes to interact with an associated element within said plurality of elements; and flexure of each of said interacting dynamic spikes is guided by its associated element.

9. A cleat system for an athletic shoe to be worn by a wearer, the cleat system comprising:

an outsole including:

a ground-engaging surface; and a receptacle operable to receive a stud formed into the outsole, the receptacle having a circumference;

a pair of traction elements spaced within a radial distance of the receptacle, the traction elements protruding from the ground-engaging surface, wherein the pair of traction elements includes first traction element oriented in spaced relation from the second traction element to define a space between the first traction element and the second traction element; and a stud including:

a flange, and a dynamic spike extending angularly from flange, the dynamic spike including a proximal end, a distal end, a first circumferential side, and a second circumferential side, wherein the dynamic spike is configured to flex radially outward toward the traction elements upon the application of the weight of the wearer, and a locking feature that to secure the stud in the receptacle in a specific rotational position relative to the receptacle and the outsole such that the dynamic spike is oriented to enter the space defined between the first traction element and the second traction element, wherein the dynamic spike is configured to flex radially outward along the ground engaging surface of the outsole to extend into the space defined by the pair of traction elements such that the first traction element is disposed on the first circumferential side of the dynamic spike and the second traction element is disposed along the second circumferential side of the dynamic spike, and wherein the movement of the dynamic spike is guided into the space by at least one of the traction elements.

10. The cleat system of claim 9, wherein the traction elements are static elements that do not flex when the weight of the wearer is applied.

11. The cleat system of claim 10, wherein:

the receptacle comprises a threaded socket;

the flange comprises an upper surface and a lower surface;

the dynamic spike extends distally from the lower surface; and the stud further includes a threaded member extending distally from the upper flange surface, wherein the threaded member is adapted to threadingly engage the socket to orient the dynamic spike in the specific position.

12. The cleat system of claim 9, wherein:

the stud comprises a plurality of dynamic spikes extending angularly from the flange; and the outsole comprises a plurality of traction elements disposed proximate the receptacle to define a plurality of spaces, each space operable to receive one of the plurality of dynamic spikes.

13. The cleat system of claim 12, wherein the plurality of traction elements is oriented in an array along and spaced from the circumference of the receptacle.

14. The cleat system of claim 12, wherein:

the studded shoe outsole is coupled to a shoe worn by a wearer; and the plurality of dynamic spikes extends downward and outward from the flange under no load conditions and resiliently flex outward relative to the flange under load from the weight of a wearer of the shoe.

15. The cleat system of claim 12, wherein the traction elements:

are positioned at a radially spaced position from the receptacle such that the traction elements are positioned interspersed with and on opposite circumferential sides of respective dynamic spikes when the dynamic spikes are flexed under load; and selectively guide the flexure of respective dynamic spikes as they flex.

16. The cleat system of claim 9, wherein the traction elements are positioned within the radial distance from respective studs and sufficiently proximate at least one of said dynamic spikes to guide said at least one spike as it flexes under load.

17. The cleat system of claim 9, wherein the dynamic spike contacts at least one of the traction elements when flexing under the wearer weight such that the movement of the dynamic spike is guided into the space defined by the traction elements.

18. A method of providing traction in an athletic shoe, the method comprising:

(a) obtaining an athletic shoe comprising:

an outsole, a receptacle mounted in said outsole and having an internally threaded socket, a stud having a flange, a threaded spigot extending from an upper side of said flange for threadedly engaging said socket about an axis, and at least one ground engaging dynamic spike extending from a lower side of said flange, said dynamic spike being sufficiently flexible to flex under the weight of a wearer of said shoe, an element extending downward from said outsole, wherein the axial height of said element is less than the axial extent of the dynamic spike, and a locking feature to secure said stud in said receptacle in at least one specific rotational position relative to said receptacle and said outsole when said spigot is threadedly engaged in said socket, wherein, in said specific rotational position, said dynamic spike is oriented to contact with said element, wherein said dynamic spike, in said specific rotational position and when flexing under said wearer weight interactively contacts said element;

(b) positioning the element sufficiently proximate the replaceable stud such that the dynamic spike, in the specific rotational position and flexing under the wearer weight, contacts the element.

19. The method of claim 18 wherein the step of positioning comprises locating the element in the shoe outsole sufficiently proximate the receptacle to permit the element to interact with the dynamic spike when flexing under said wearer weight.

20. The method of claim 18, wherein the element is a relatively inflexible member.

21. The method of claim 18 wherein the step of positioning comprises locating the element to contact the dynamic spike when the dynamic spike flexes under the weight of the wearer of the shoe.

22. The method of claim 18, wherein the element is a flexible member.

* * * * *